US006029776A

United States Patent [19]

Brown

[11] Patent Number: 6,029,776

[45] Date of Patent: Feb. 29, 2000

[54] HOLDING DEVICE FOR LADDERS AND THE LIKE

[76] Inventor: Robert L. Brown, 649 Henry St., Marion, Ohio 43302

[21] Appl. No.: 08/946,634

[22] Filed: Oct. 7, 1997

Related U.S. Application Data

[60] Provisional application No. 60/032,098, Dec. 4, 1996.

[51] Int. Cl.[7] ..... E04G 1/00

[52] U.S. Cl. ..... 182/129; 248/210

[58] Field of Search ..... 182/129; 248/210, 248/238

[56] References Cited

U.S. PATENT DOCUMENTS

| | | | |
|---|---|---|---|
| 3,822,846 | 7/1974 | Jesionowski | 182/129 X |
| 4,222,541 | 9/1980 | Cillis | 248/210 |
| 4,515,242 | 5/1985 | La Chance | 182/129 X |
| 4,964,601 | 10/1990 | Dishman | 182/129 X |
| 4,979,710 | 12/1990 | Baldwin | 248/210 |
| 5,374,019 | 12/1994 | Fisher | 248/122 |
| 5,507,363 | 4/1996 | Tredup | 182/129 |

*Primary Examiner*—Daniel P. Stodola
*Assistant Examiner*—Hugh B. Thompson
*Attorney, Agent, or Firm*—Standley & Gilcrest LLP

[57] ABSTRACT

The invention relates to holding device adapted to attach to a ladder having rungs. The holding device comprises: (a) a substantially flat holder member defining a holder plane; (b) a hook adapted to engage one of the rungs, the hook being adjustable with respect to the holder plane, and lockable in at least two orientations with respect to the holder plane.

10 Claims, 12 Drawing Sheets

HOLDING DEVICE FOR LADDERS AND THE LIKE

This application claims the benefit of U.S. Provisional Application Serial No. 60/032,098 filed on Dec. 4, 1996.

TECHNICAL FIELD

The present invention is in the field of ladders and scaffolds, such are used in the building, painting and cleaning trades, and for household use; and is used for holding items while using ladders and scaffolds.

BACKGROUND

Ladders and scaffolds find applications in many trades, such as the building, painting and cleaning trades. Also, ladders are commonly used in the household for a wide variety of tasks.

Both commercial and household uses of ladders and scaffolds typically involve the use of tools and/or chemical agents, such as cleaners and paints.

Naturally, it is desirable to be able to hold tools and other materials on a ladder or scaffold securely and easily within reach of the user. Many ladders come equipped with fold-out shelves that are part of a folding ladder structure near the top of the ladder and opposite the ladder stairs or rungs. These shelves are difficult to use because they require the user to reach around or through the ladder, they remain only at one height, and they require that the folding ladder be completely unfolded to be operative. Straight ladders typically do not come equipped with shelves.

Accordingly, an object of the present invention is to provide an adjustable shelf that can be used at a variety of heights and on a wide variety of ladders or scaffolds.

It is also an object of the present invention to provide such a shelf which is convenient to use and which cannot be used improperly as a step.

The present invention also has as an object to provide a shelf or other holder that can be used without interfering with the ascent or descent of the user on the ladder or scaffold.

SUMMARY OF THE INVENTION

In broadest terms, the present invention includes a holding device adapted to attach to a ladder having rungs, the holding device comprising: (a) a substantially flat holder member defining a holder plane; (b) a hook adapted to engage one of the rungs, the hook being adjustable with respect to the holder plane, and lockable in at least two orientations with respect to the holder plane.

It is preferred that the hook be lockable in a plurality of orientations with respect to the holder plane. This may be accomplished by the holder member and the hook each being provided with orientating surfaces which are adapted to be releasably engaged so as to allow the hook to be lockable in a plurality of orientations with respect to the holder plane. The ability of the hook to be lockable in a plurality of orientations with respect to the holder plane allows the holder to be adjusted so as to accommodate any angle of the ladder staves (or sidepieces) when the ladder is being used. The hook is preferably attached at a point that will allow the holder to bear against the ladder stave. For instance, the hook may be oriented along one side of the holder so as to allow the holder to rest against the ladder stave and extend from the side of the ladder, clearing the path of the ladder rungs. The holder portion may have an extension portion that may be adjustable so as to bear against the ladder stave below the position of the holder plane in order to stabilize the holder once the hook has been placed in position on the stave. In an alternative embodiment, the adjustable hook itself may have an extension rod that is designed to bear against the ladder stave below the position of the holder plane in order to stabilize the holder once the hook has been placed in position on the stave. The description of the preferred embodiment shows this in more detail.

In another preferred embodiment, the holding device may be such that the holder member additionally includes at least one drawer that might be used for holding painting supplies or tools. In another embodiment, the holder member is provided with at least one drain hole that may be used to allow spilled paint or other liquids to drain.

The holder member and the hook may be made of any appropriate dimensionally stable material, such as wood, plastics and metals.

The present invention is a versatile device that may be attached to any extension ladder, straight ladder, folding ladder, scaffolding, etc., and can be used as a tool stand, paint or paint brush holder etc. For instance, one use of the present invention is as a paint rack for holding a gallon paint can, paint brushes (that may be put in holes in the holder plate) and a few tools that may be placed in an optional drawer or shelf beneath the holder table itself. Such a drawer or shelf may be removable.

The dimensions of the table intended for use in painting should be just large enough square to accommodate the gallon paint can and the optional lower shelf may be approximately 2 inches deep. For example, if the table is eight inches by eight inches with a 0.75 inch lip around the perimeter the removable shelf may be about 7.75 inches square and 2" deep and may rest on a lower extension of the table.

The shelf may be removable and would fit securely into the top of holder plate so it could be opened and the tools could be used in a convenient manner.

The present invention may be made of any appropriate material(s) such as heavy gage aluminum or plastic. For instance, the entire mechanism except for the locking screw may be made of high density, high impact plastic and would be able to withstand the weight of at least two full gallons of paint and a drawer full of tools.

Additional optional features may include a mechanism that adjusts and maintains the angle of the table in discrete positions, such as through an intermeshing series of radial grooves with "V" cross-sections which extend and expand radially, that could be locked into one another in a plurality of orientations (typically 5, 10 or even 30 possible orientations). Other such arrangements may include such variations of mechanical arrangements and surfaces that are adjustable and lockable by pressure of mechanical opposition, such as opposed peg-and-hole arrangements, opposed cooperating rib arrangements, and simple opposing roughened surfaces; all of which can be applied to make the ladder table adjustable.

One or more drawers or shelves (with or without doors) may be attached to the ladder table, such as just below the table itself, to contain brushes, screwdrivers, and other tools or fasteners, such as screws, nails, etc., for use as a storage area when working on the ladder.

The attaching hook could be on a pivot so as to be able to engage the rung of the ladder onto which the holder table is to be attached. The stabilizing lug that contacts the bottom of the attachment area of the ladder may be made so as to provide an asymmetrical rotating ring on the end that could be rotated and act as a cam to tighten the table to the ladder for better stability.

Appropriate cautionary legends, such as the words "DO NOT STAND ON OR HANG FROM THIS DEVICE" and a weight limit may be printed or molded into the holder plate's rim so as to be visible to the user during use.

DETAILED DESCRIPTION OF THE PREFERRED EMBODIMENT

In accordance with the foregoing summary of the invention the following presents a detailed description of the preferred embodiment of the invention, presently considered to be the best made of the invention when applied to the painting trades.

Figure 1:
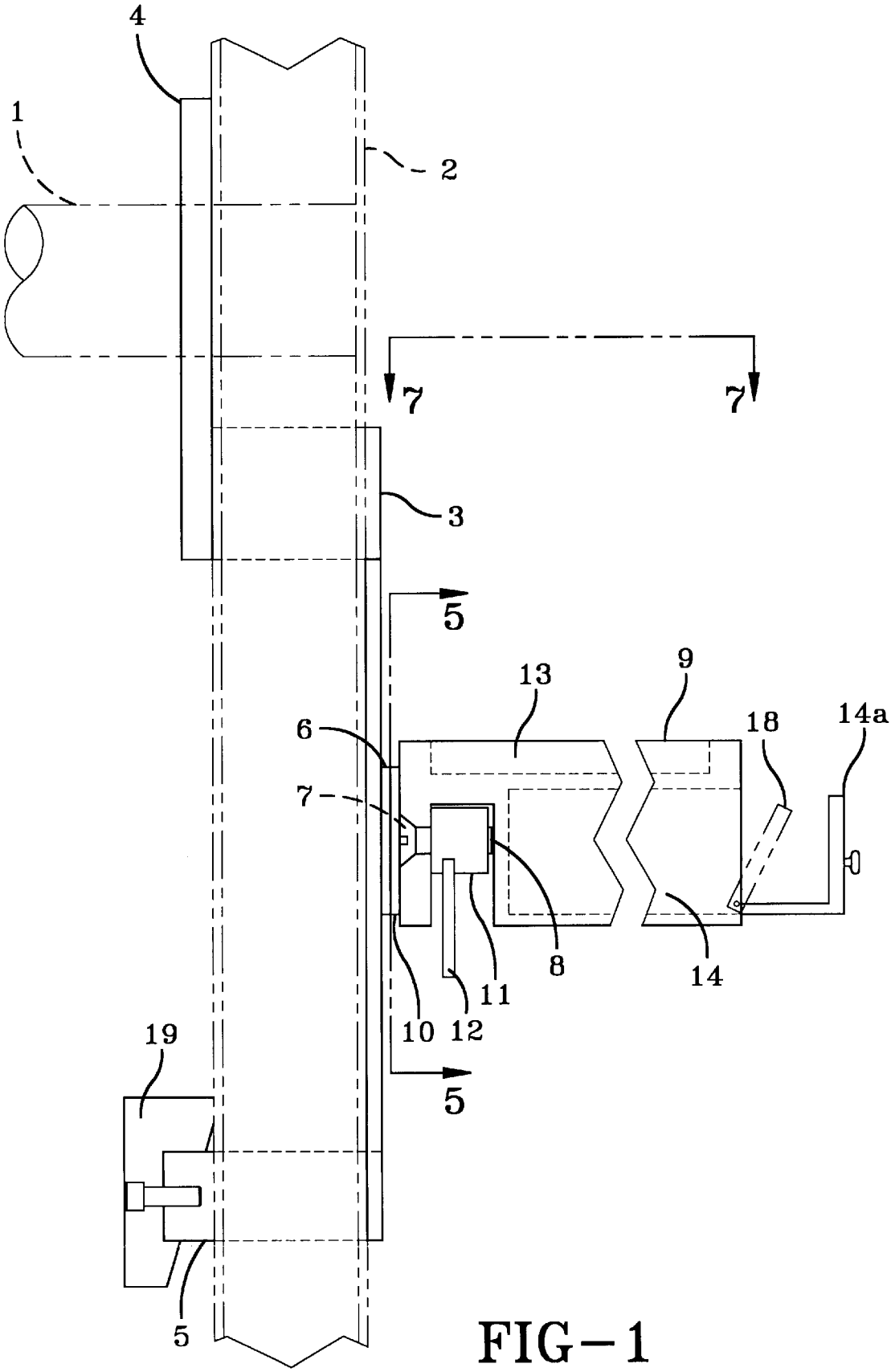
FIG. 1 is an elevational, environmental view of a ladder table in accordance with one embodiment of the present invention.

FIG. 1 shows an elevational view of the ladder table in accordance with the preferred embodiment of the invention seen as it would appear by the operator viewing the ladder table in place along one lateral support of a straight ladder. FIG. 1 shows ladder rung (1) on ladder support (2). The attachment portion (3) comprises a hook portion (4) which is adapted to engage ladder rung (1). The attachment portion (3) also includes an abutting portion (5) which is adapted to abut against the facing side of ladder support (2) to maintain it from swinging about ladder rung (1). Abutment portion (5) may also be provided with a swivel cam (19) that is rotatable about the abutment portion and which will oppose the static force of the attachment portion (4), thus locking the entire arrangement onto the ladder. Attachment portion (3) also is provided with a discreet positioning mating portion (6) and an aperture (7) through which bolt (8) extends so as to attach to and be locked in positional relationship with table portion (9). Table portion (9) also includes a discreet positioning mating portion (10). In the shown embodiment the discreet positioning portions (6 and 10) are disks with an equal number of radially extending v-grooves which mate with one another so that the attachment portion and table portion can be locked in a desired orientation (normally with the table portion held substantially normal to the pull of gravity with the attachment portion positioned to correspond to the angle of the ladder in the working position). The two discreet positioning portions are held in mated relationship through the action of bolt (8) with nut portion (11) which in turn, is provided with an extension handle (12) so that the operator may conveniently slightly loosen and then re-tighten the nut and bolt combination in order to be able to turn the table portion with respect to the attachment portion to achieve the desired angular orientation. In the shown embodiment, the table portion may optionally be provided with a hollowed top to form a well portion (13) as is indicated by dotted lines, which provides walls along the sides of the table top so as to help prevent spillage or the dropping of tools during use of the table for holding paints, varnishes or stains, or when holding tools such as paint brushes, hand tools, etc. The embodiment shown in FIG. 1 also shows that the table portion may be provided with one or more drawer spaces which can be provided with a drawer to help contain tools and small work items such as fasteners, such as hooks, nails, screws, etc. In this embodiment, the drawer portion (14) may be supplied with drawer (14*a*) or, in an alternative embodiment, may be fitted with a door (18).

Figure 2:
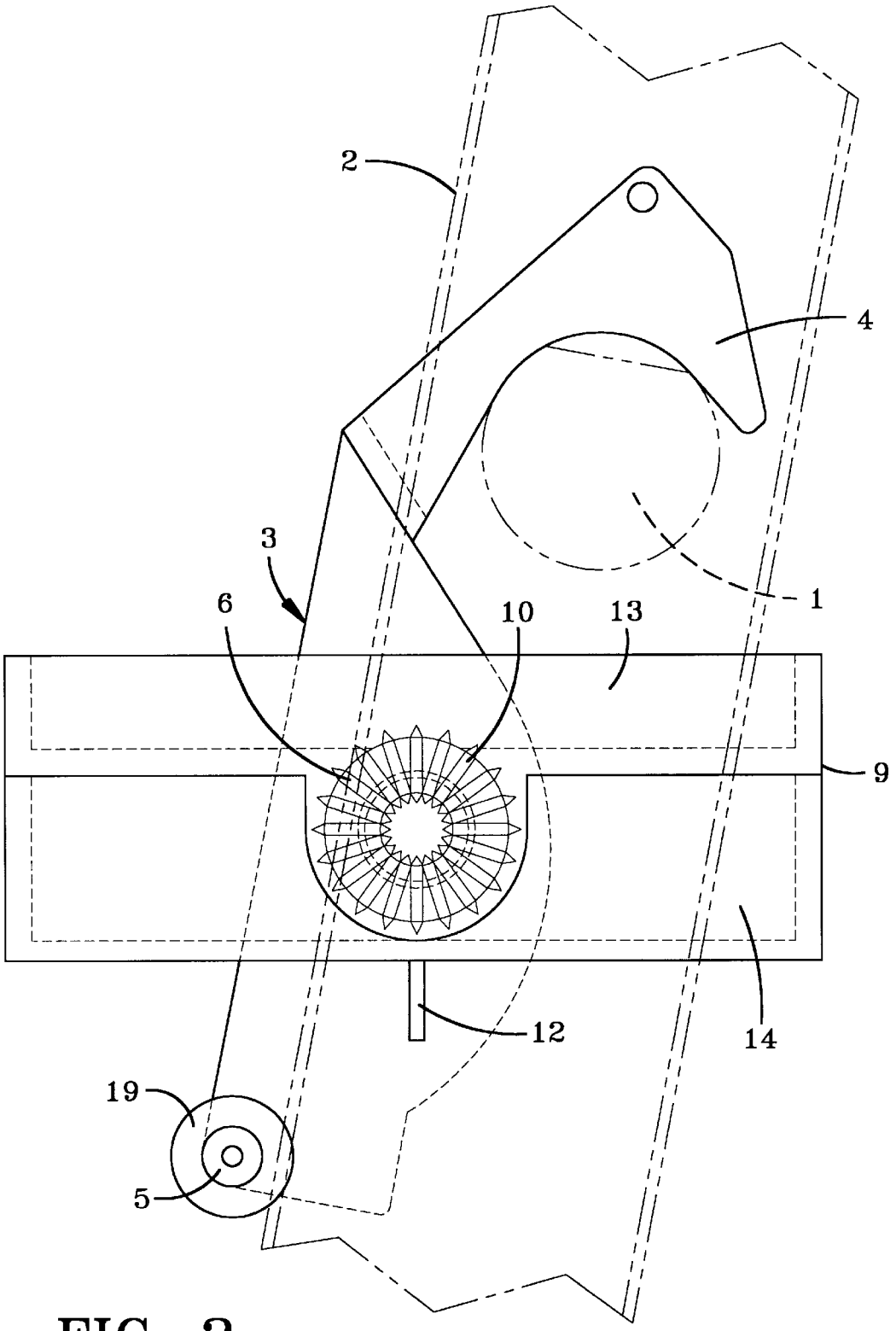
FIG. 2 is a lateral, elevational, environmental view of a ladder table in accordance with one embodiment of the present invention.

FIG. 2 is a view of the preferred embodiment of the present invention as seen as viewed along line 2—2. All of the numerical references in FIG. 2 are the same those taken from FIG. 1. FIG. 2 more clearly shows the position of the attachment portion (3) with its hook (4) extending over rung (1) attached to ladder support (2). Also shown is the abutting portion (5) which abuts atop ladder support (2). The discreet positioning portions (6 and 10) can be seen as they would appear when viewed through table portion (9) and drawer portion (14) which, in this embodiment, is shown as having well portion (13) and optional drawer portion (14) (optional drawer **(14*a*) and door (18) not shown). This view also shows extension portion (12) as described in FIG. 1**.

Figure 3:
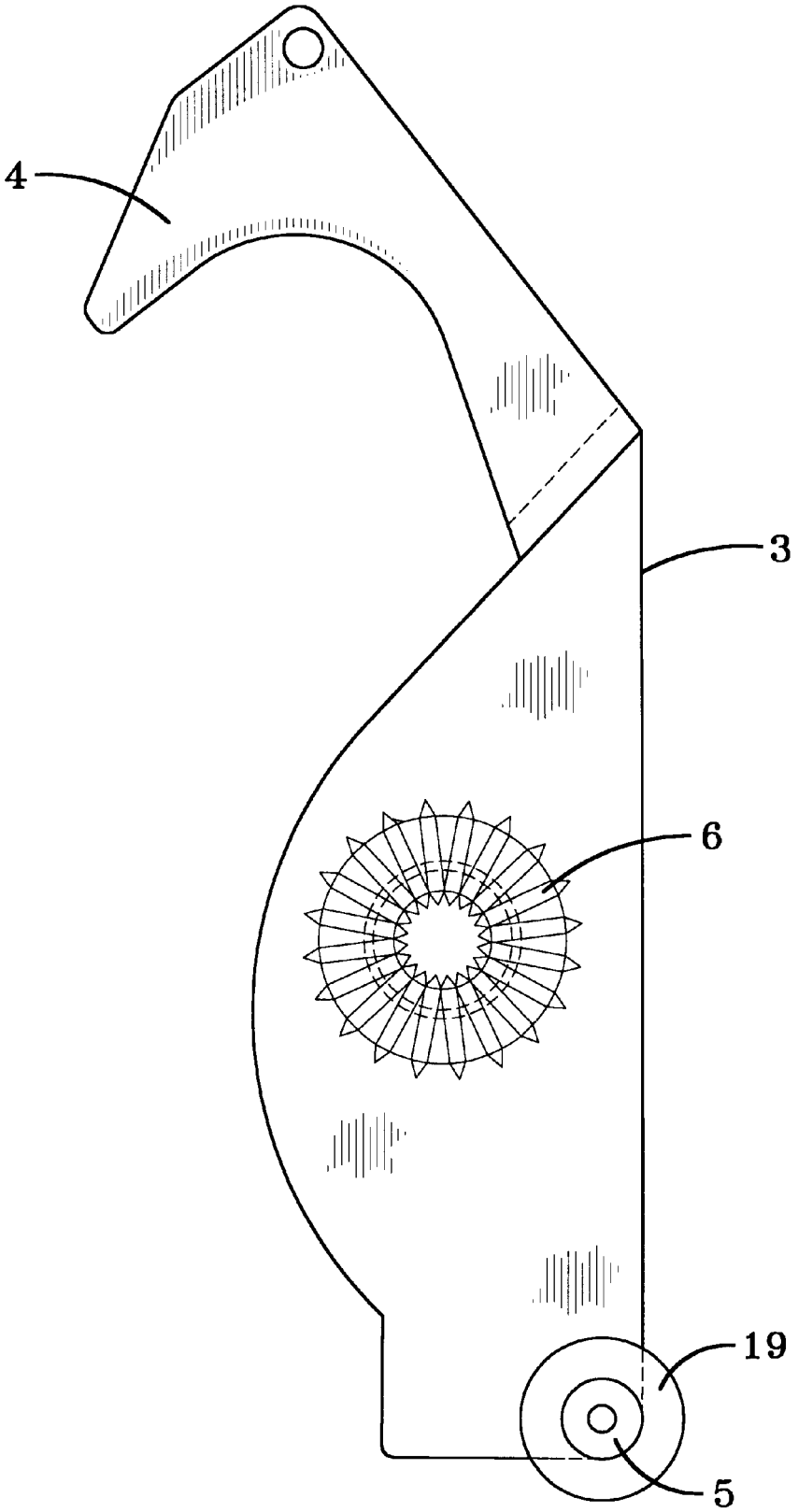
FIG. 3 is a side, elevational view of the attachment portion of a ladder table in accordance with one embodiment of the present invention.
Figure 4:
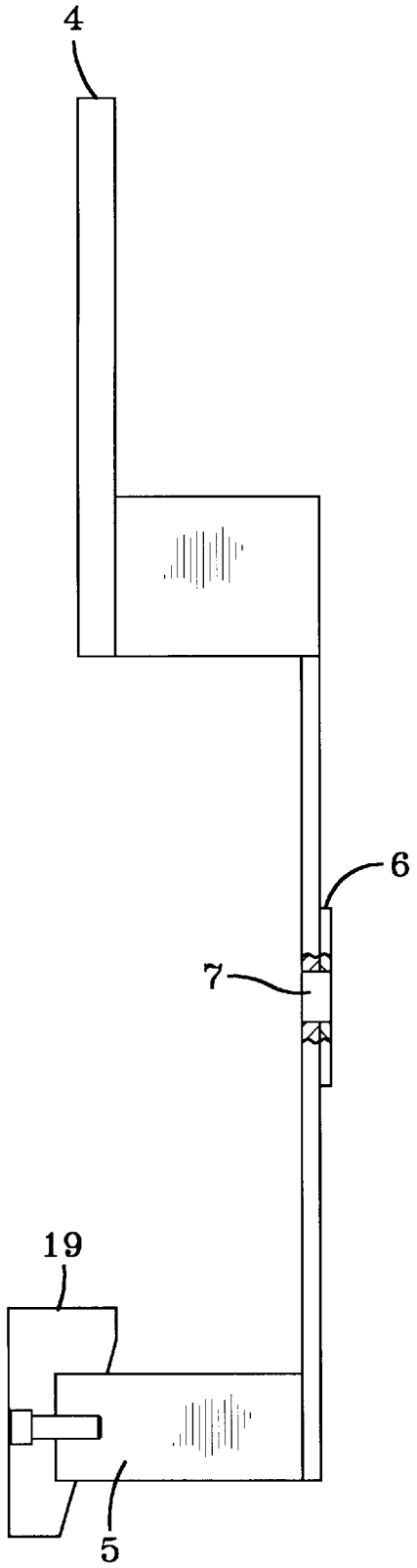
FIG. 4 is an end-on, elevational view of an attachment portion of a ladder table in accordance with one embodiment of the present invention.

FIG. 3 shows a side elevational view of the attachment portion (3) used in accordance with the preferred embodiment of the present invention. FIG. 3 shows hook portion (4) and abutment portion (5) as well as discreet positioning portion (6) (shown in phantom). The dimensions and radii given in FIG. 3 are expressed in inches. FIG. 4 is a rear elevational view of the attachment portion (3), as it would be viewed in the orientation as seen in FIG. 1. FIG. 4 shows attachment portion (3) with hook portion (4) and abutment portion (5). FIG. 4 also shows aperture (7) which is adapted to accept the bolt (8) shown in FIG. 1.

Figure 5:
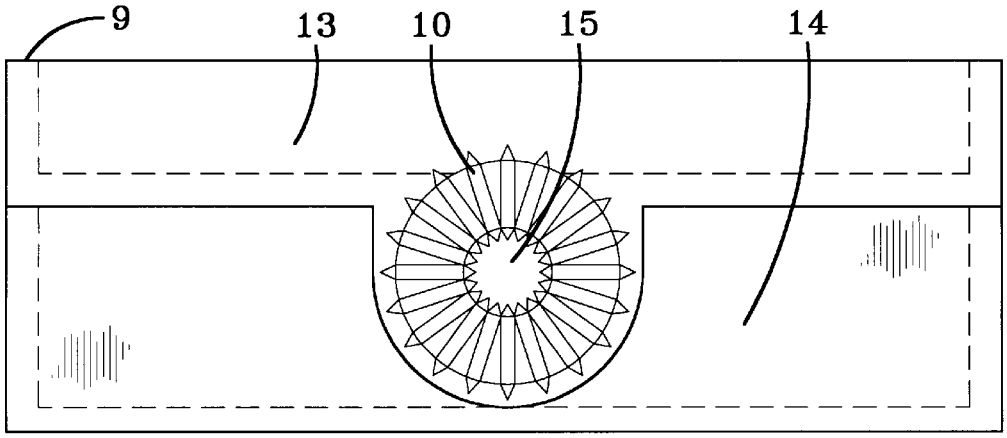
FIG. 5 is a side, elevational view of the table portion of a ladder table in accordance with one embodiment of the present invention.

FIG. 5 shows a side elevational view of the table portion (9) of the present invention as it would be viewed along line 5—5 of FIG. 1 (i.e., as seen from the engagement side that faces the attachment portion (3)) without the bolt (8) or nut (11) in place. FIG. 5 shows table portion (9) having hollow portion (13) and a drawer portion (14). Also shown is discreet positioning portion (10) and aperture (15) through which bolt (8) passes (as shown in FIG. 1). The dimensions and radii given in FIG. 5 are expressed in inches.

Figure 6:
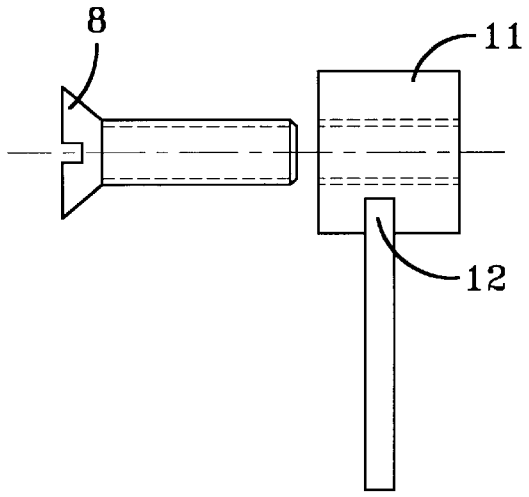
FIG. 6 is a detailed view of a nut, bolt and extension handle that may be used in accordance with one embodiment of the present invention.

FIG. 6 is a detailed view of the bolt (8) and extension handle (12) as shown in FIG. 1. This Figure also shows how bolt (8) fits into nut (11). The bolt (8) may be made of plastic or metal, and could be molded into the hook mechanism itself. The nut portion (11) may also be made of a wear-resistant material and contain internal threads to match the locking bolt (8). The extension arm (12) may be made of metal to extend below the ladder table for easy access and to provide a sufficient amount of leverage to ease the locking of nut portion (11) onto locking bolt (8). The throw of the locking arm (12) may be 140°. The bolt may be a very coarse 4 TPI for locking, and the combined bolt and nut naturally must fit into the space between the drawer space (if provided) and the table side face with the discreet positioning portion.

Figure 7:
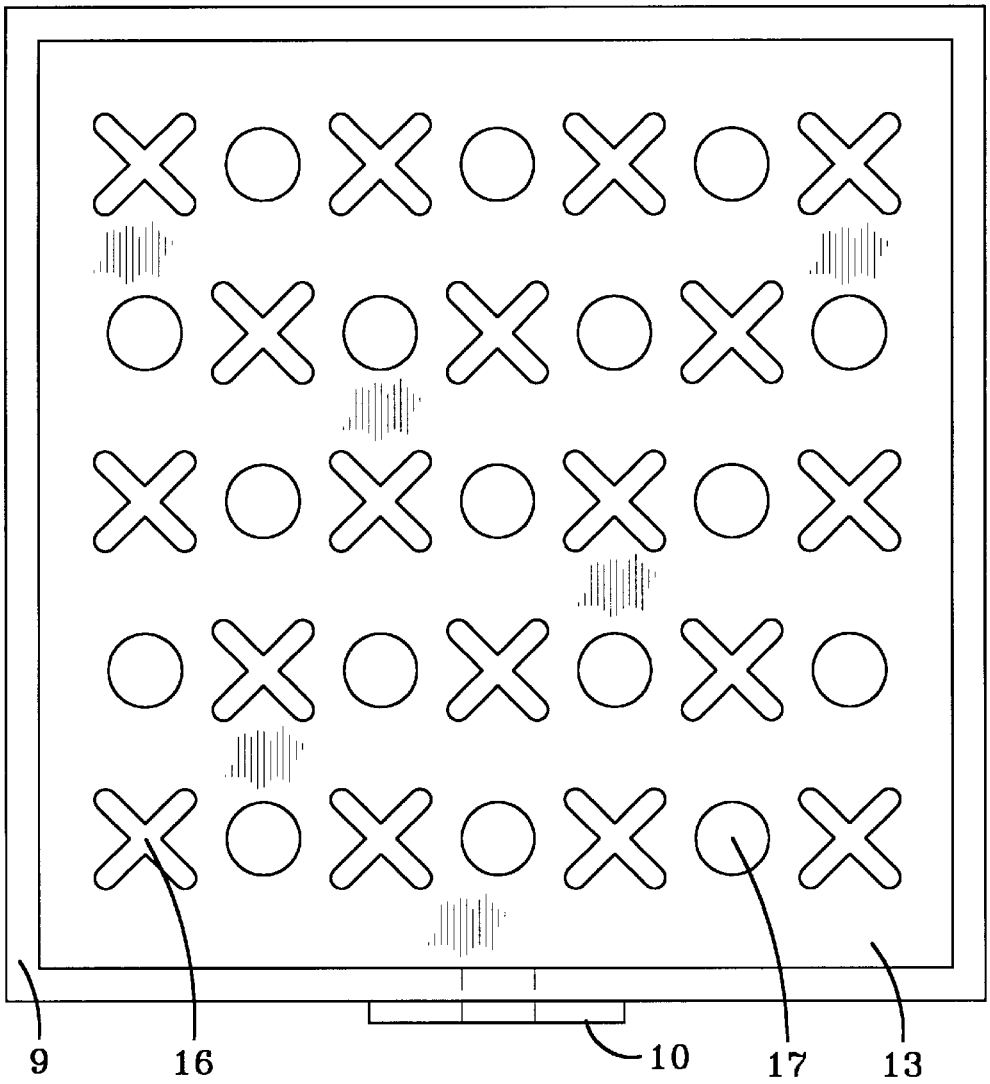
FIG. 7 is a plan view of the table portion of a ladder table in accordance with one embodiment of the present invention.

FIG. 7 is a plan view taken along line 7—7 of FIG. 1. FIG. 7 shows table portion (9) having hollow well (13) which is provided with texturing portions (16) to prevent slippage of a paint can placed thereupon. FIG. 7 also shows optional drain holes (17) that might be applied in an embodiment of the present invention that either uses no drawer, or are used in portions of the table portion that do not reside above the drawer (where the drawer is not as wide as the table portion, allowing spilled paint to drip through the table in the case of spills, if desired).

Figure 8:
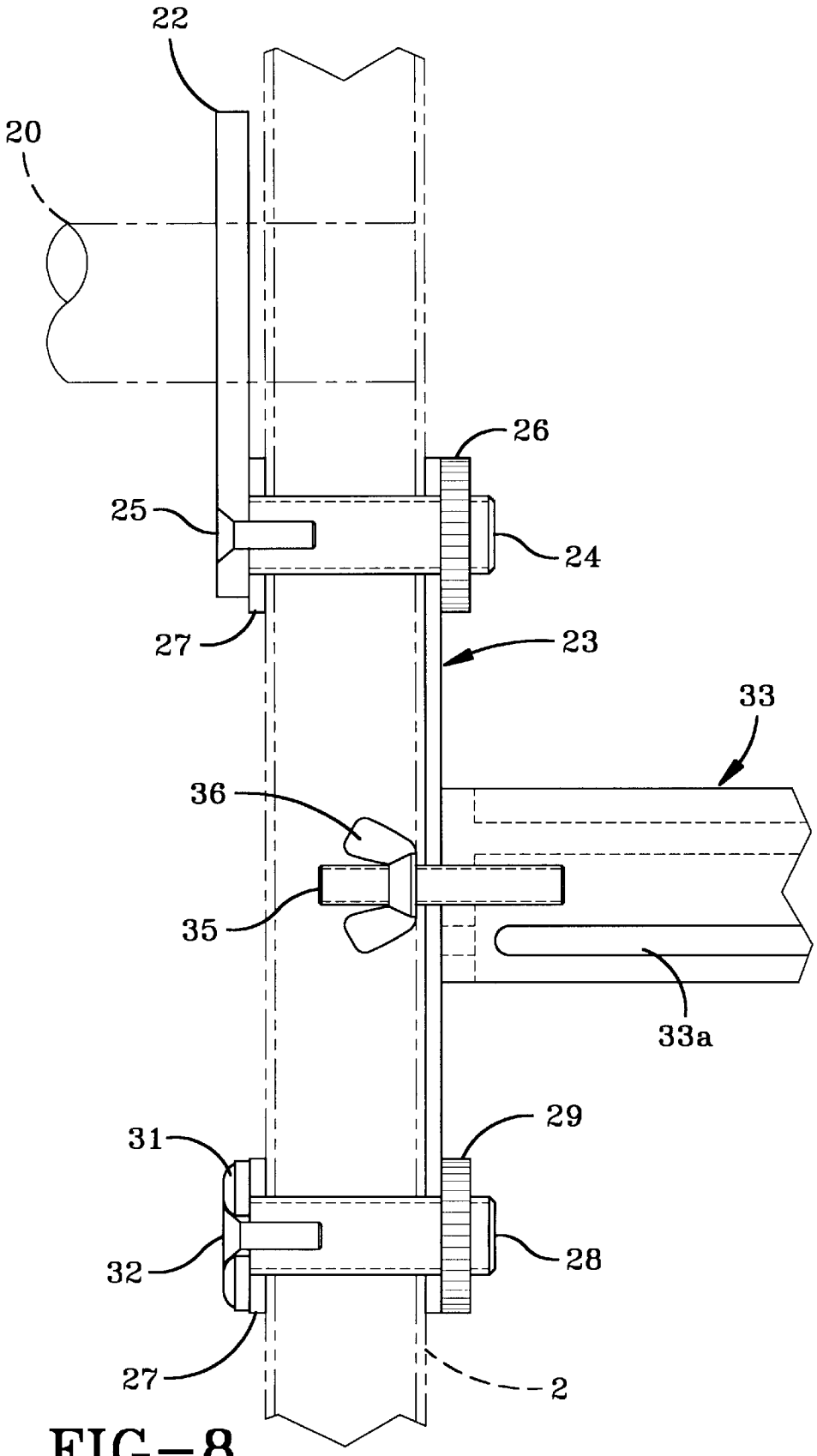
FIG. 8 is an elevational, partially sectioned environmental view of a ladder table in accordance with one embodiment of the present invention.

FIGS. 8 through **15*a*** show an alternative embodiment of the present invention.

FIG. 8 is an elevational, partially sectioned environmental view of a ladder table in accordance with one embodiment of the present invention shown as it would be attached to a simple metal ladder with rung 20 perpendicular to its sidepiece support 21. FIG. 8 shows an embodiment of the invention that involves the ladder attachment portion being rendered in two pieces, a hooking component 22 and a bracket component 23. FIG. 8 shows that hooking component 22 engages rung 20 and includes a screw component 24 which may be attached by screw 25 (which preferably allows pivotal orientation to be changed and locked into place by tightening screw 25), or otherwise, such as by welding it onto hooking component 22. The screw component 24 is used to attach hooking component 22 to bracket component 23 by passing though an aperture in bracket component 23 and being releasably locked into place by screw lock 26 and optional flange lock 27 (which may be used with a ladder such as an aluminum ladder which may have shaping along the ladder edge, such as the recess indicated by the dotted lines running along the ladder edge shown in FIG. 8). In similar fashion, the screw component 28 is used to urge bracket component 23 against the outboard side of sidepiece support 2 by passing though an aperture in bracket component 23 and being releasably locked into place by screw lock 29 and optional flange lock 30 which functions as described with respect to optional flange lock 27. The screw component 28 may be a simple screw or bolt, or may have a screw cap 31 which is held in place by screw 32.

The ladder table 33 (with or without provision for one or more drawers, such as may be supported by drawer slots **33*a*) may be held in place by attachment to bracket component such as screw 34 which allows the ladder table to be pivoted, and by bolt 35 and wing nut 36 that allow the ladder table to be locked into an orientation on the pivot arc (see FIG. 9) through arc slot 41**.

Figure 9:
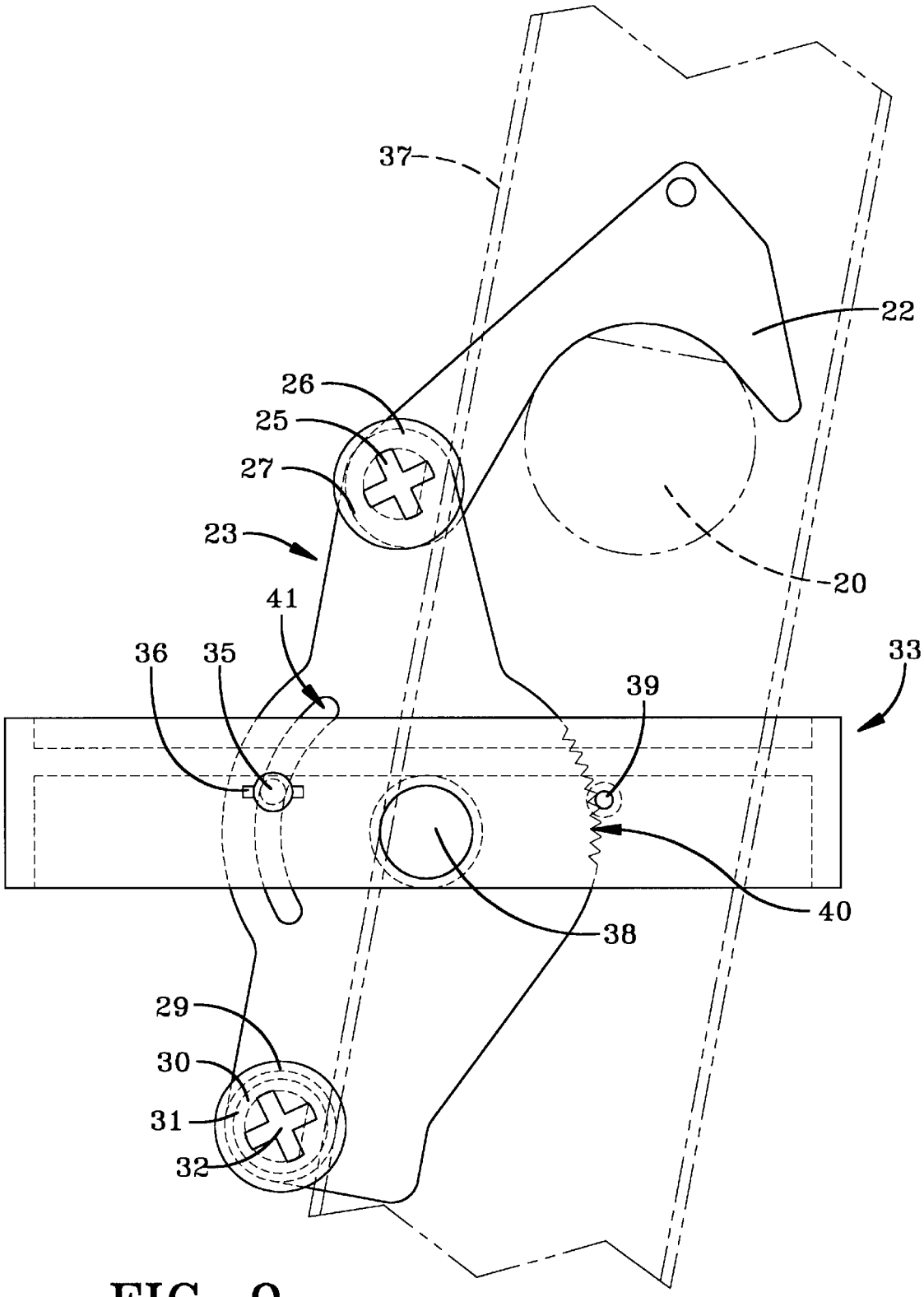
FIG. 9 is an elevational view of the ladder table device shown in FIG. 8 as viewed along line 9—9 of FIG. 8.

FIG. 9 is an elevational view of the ladder table device shown in FIG. 8 as viewed along line 9—9 of FIG. 8. The same reference numerals used in FIG. 8 apply to FIG. 9.

FIG. 9 also shows ladder flange 37 engaged by the locking flanges 27 and 30.

FIG. 9 also shows that screw components 24 and 28 optionally may be flat-sided bolts or similar flat-sided attachments that allow them to rest securely against the ladder edge 21.

Also visible in FIG. 9 is the pivot boss 38 into which screw 34 fits to allow ladder table 33 to pivot and be locked into place. FIG. 9 also shows locator pin 39 and corresponding shaping 40 of a portion of the side of the bracket component 23, that function to orient the ladder table with respect to the bracket component (and ultimately the ladder itself once all of the joints are fixed).

This arrangement allows the ladder table to be held in position both by action of the hook (preventing downward vertical displacement and horizontal displacement toward the user) and the clamping action of the multi-piece hook (principally additionally preventing lateral displacement to the side of the ladder).

Figure 10:
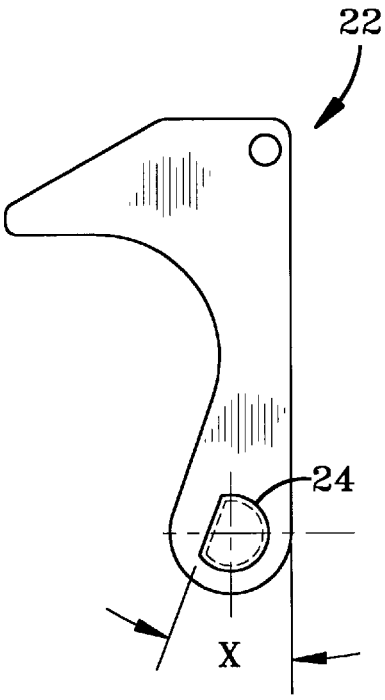
FIG. 10 is a side elevational view of the hooking component in accordance with one embodiment of the present invention.

FIG. 10 is a side elevational view of the hooking component 22 showing screw component 24.

Figure 11:
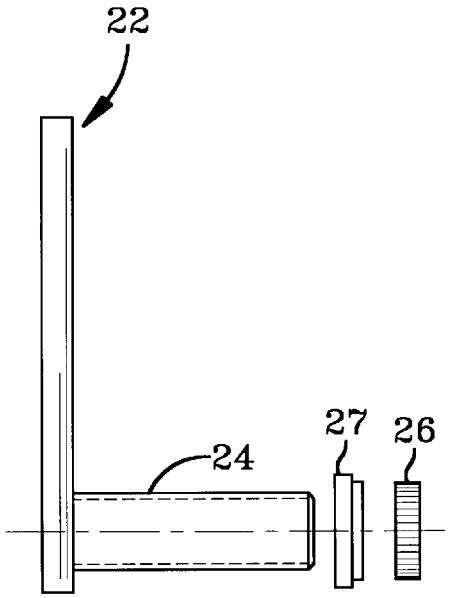
FIG. 11 is a front exploded elevational view of the hooking component in accordance with one embodiment of the present invention.
Figure 11A:
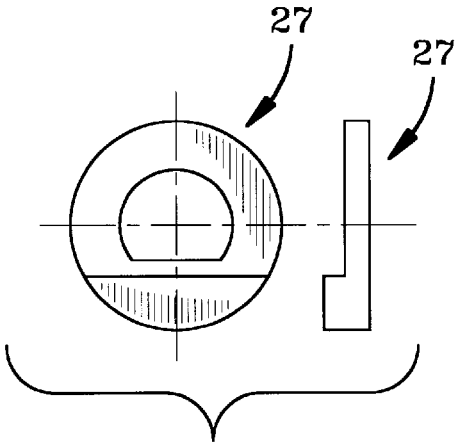
FIG. 11*a* is a detailed plan of view of flange lock in accordance with one embodiment of the present invention.
Figure 11B:
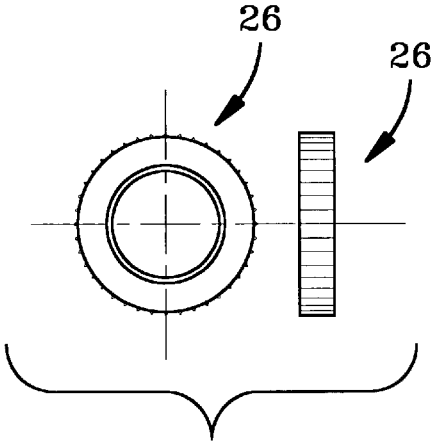
FIG. 11*b* is a detailed view of screw lock in accordance with one embodiment of the present invention.
Figure 11C:
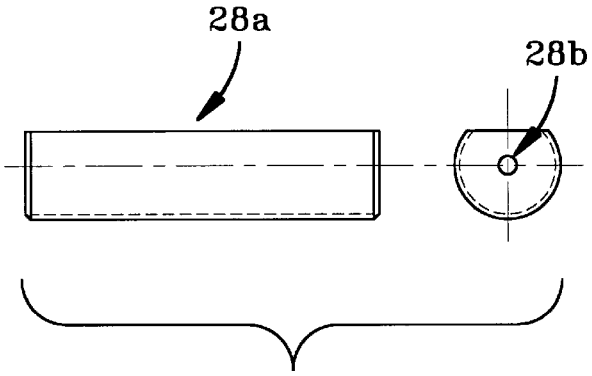
FIG. 11*c* is a detailed view of screw component in accordance with one embodiment of the present invention.
Figure 11D:
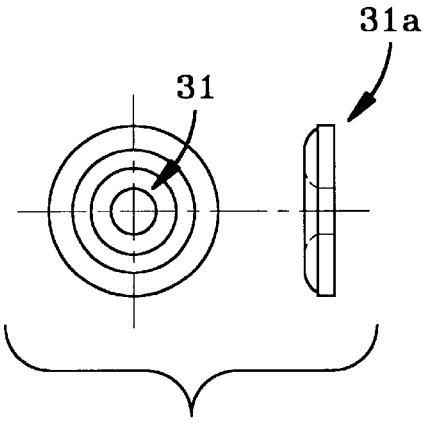
FIG. 11*d* is a detailed view of screw cap in accordance with one embodiment of the present invention.
Figure 11E:
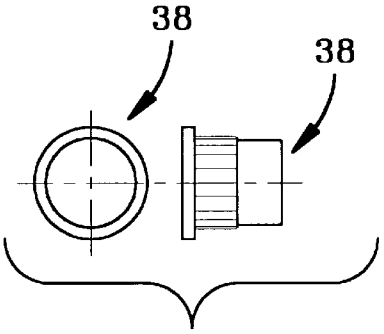
FIG. 11*e* is a detailed view of a pivot boss in accordance with one embodiment of the present invention.
Figure 11F:
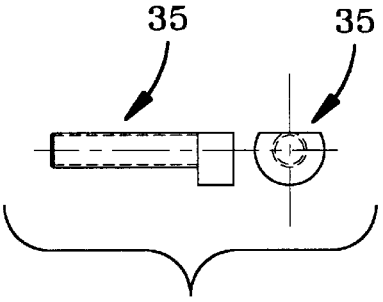
FIG. 11*f* is a detailed view of a locking bolt in accordance with one embodiment of the present invention.

FIG. 11 is a front exploded elevational view of the hooking component 22 showing screw component 24, the locking flange 27 and screw lock 26.

FIG. **11*a* is a detailed plan of view of flange lock 27 which may also be used as flange lock 30**.

FIG. **11*b* is a detailed view of screw lock 26 which may also be used as screw lock 29**.

FIG. **11*c* is a detailed view of screw component 28*a* showing the pivot hole 28*b* into which screw 32** fits.

FIG. **11*d* is a detailed view of screw cap 31 showing aperture 31*a* through which screw 32** passes.

FIG. **11*e* is a detailed view of pivot boss 38**.

FIG. **11*f* is a detailed view of locking bolt 35**.

Figure 11G:
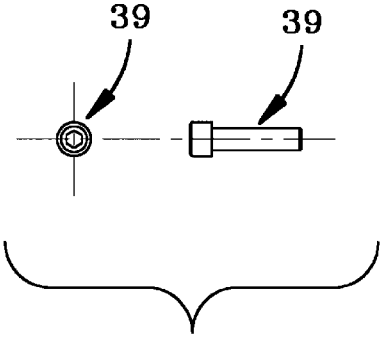
FIG. 11*g* is a detailed view of locator pin in accordance with one embodiment of the present invention.

FIG. 11*g* is a detailed view of locator pin 39.

Figure 12:
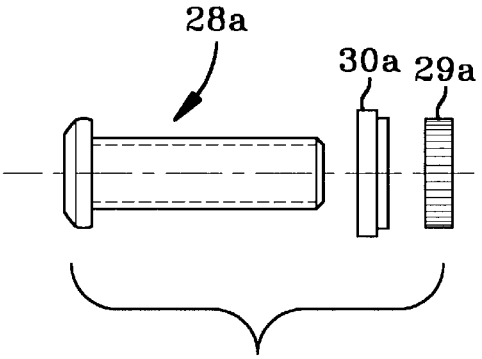
FIG. 12 is a side exploded elevational view of an optional screw component in accordance with one embodiment of the present invention.

FIG. 12 is a side exploded elevational view of an optional screw component 28*a* used as an alternative to screw component 28 to urge bracket component 23 against the outboard side of sidepiece support 2 as described above. FIG. 12 shows screw lock 29*a* and optional flange lock 30*a* which functions as screw lock 29 and optional flange lock 30 as described above. The screw component 28*a* as shown is a simple bolt, as opposed to the arrangement of a screw cap 31 which is held in place by screw 32, as described above.

Figure 13:
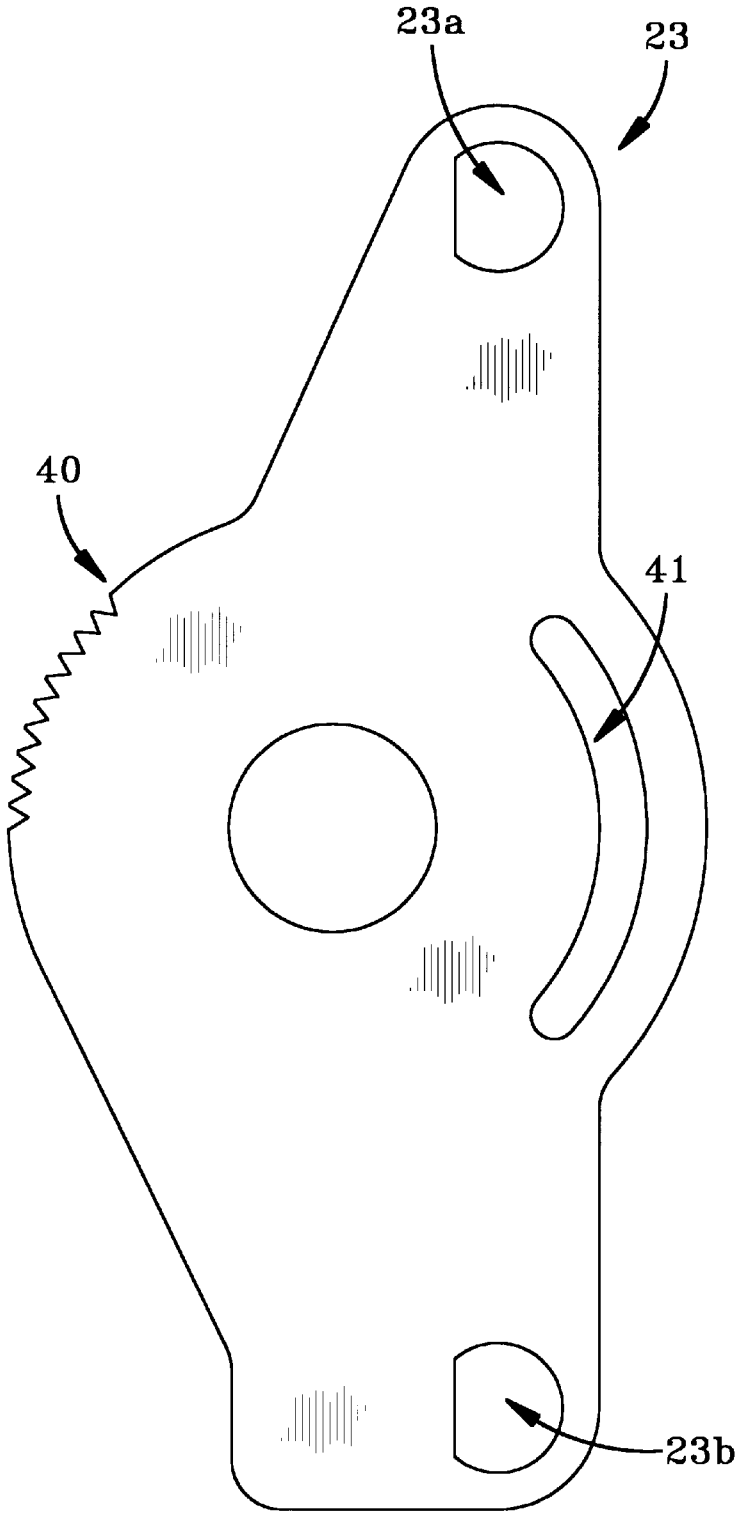
FIG. 13 is a side elevational view of connecting bracket in accordance with one embodiment of the present invention.

FIG. 13 is a side elevational view of connecting bracket 23 showing apertures 23*a* and 23*b* through which pass screw components 24 and 28, respectively as described above. Also shown are shaping 40 of a portion of the side of the bracket component 23 and arc slot 41.

Figure 14:
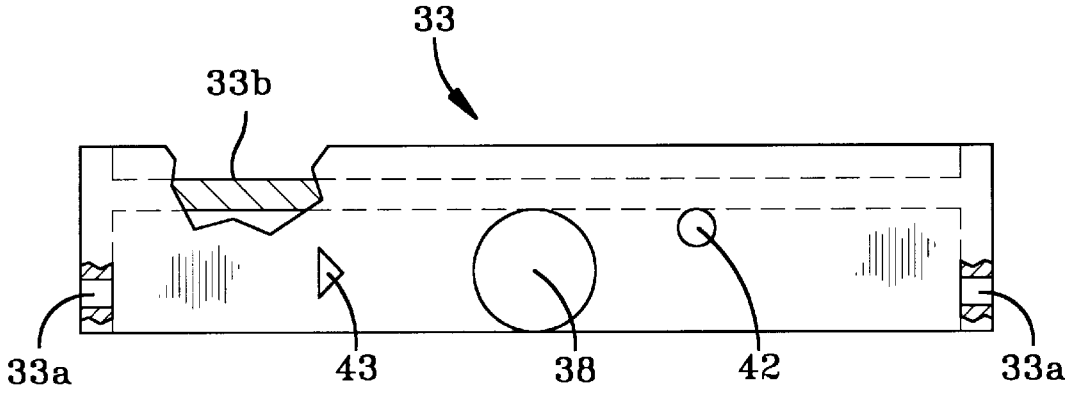
FIG. 14 shows ladder table having recessed table surface in accordance with one embodiment of the present invention.

FIG. 14 shows ladder table 33 having recessed table surface 33*b,* and featuring pivot boss 38, hole 42 for receiving locating bolt 35, and wedge-shaped locator portion 43, as an alternative to locator pin 39.

Figure 14A:
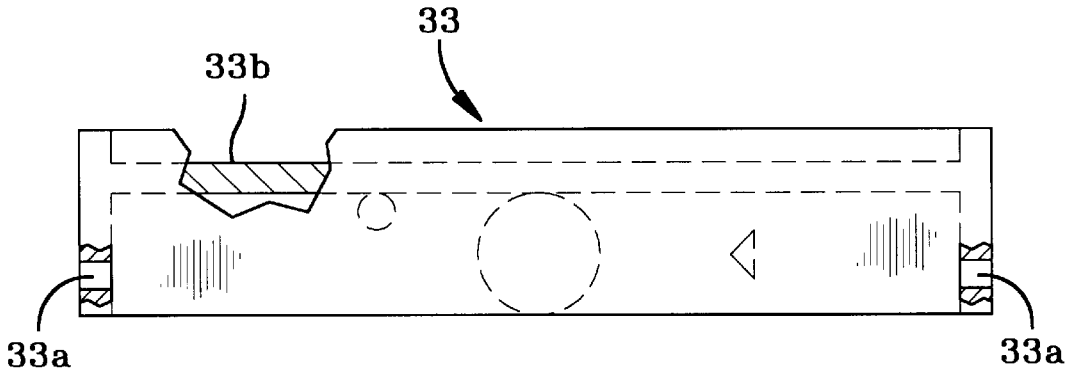
FIG. 14*a* shows the open drawer end of the one-piece ladder table in accordance with one embodiment of the present invention.

FIG. 14*a* shows the open drawer end of the one-piece ladder table 33 showing drawer slots 33*a* and ladder table surface 33*b*.

Figure 14B:
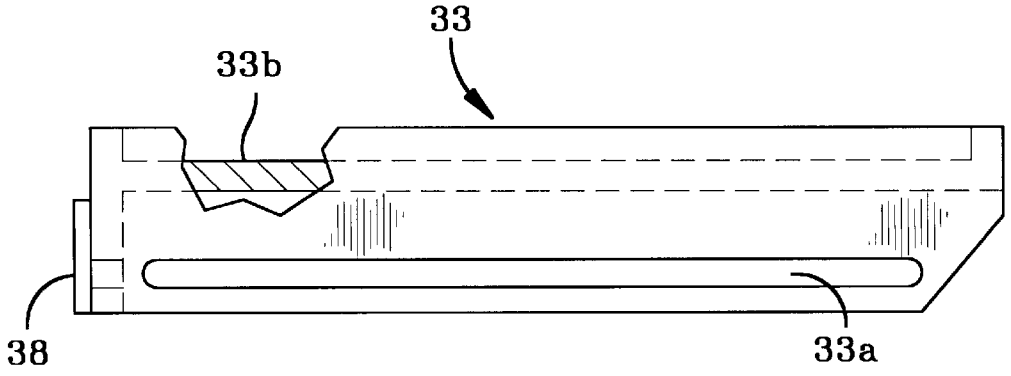
FIG. 14*b* shows a side view of a one-piece ladder table in accordance with one embodiment of the present invention.

FIG. 14*b* shows a side view of a one-piece ladder table 33 which shows table surface 33*b,* drawer slot 33*a* and pivot boss 38.

Figure 15:
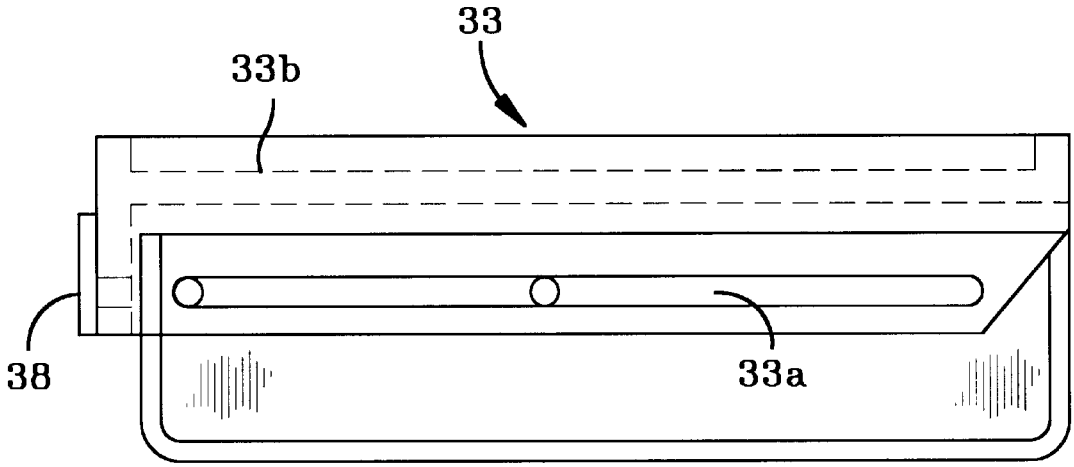
FIG. 15 is a side view of ladder table showing drawer slot in accordance with one embodiment of the present invention.

FIG. 15 is a side view of ladder table 33 showing drawer slot 33*a* and pivot boss 38. FIG. 15 also shows drawer portion 44 which engages drawer slots 33*a* through mounting-slider pegs 45.

Figure 15A:
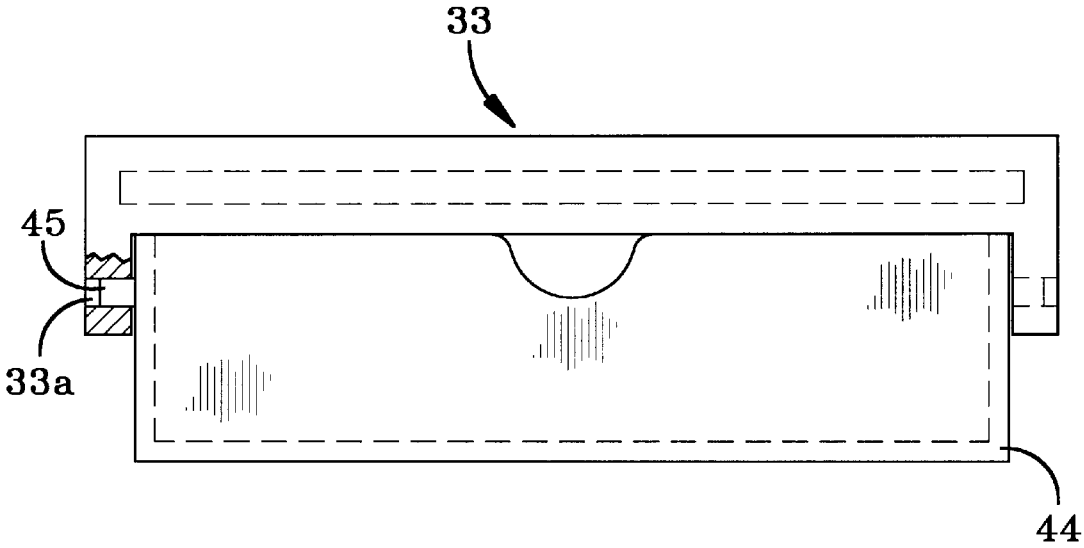
FIG. 15*a* is a frontal view of ladder table showing drawer in accordance with one embodiment of the present invention.

FIG. 15*a* is a frontal view of ladder table 33 showing drawer 44 in a closed position engaging ladder table 33 through mounting lighter peas 45 engaging drawer slots 33*a*.

The components of the ladder table of the present invention may be made of any appropriate dimensionally stable material taking into account the stress likely to be brought to bare during use. In this regard, the ladder table for instance may be made from machined metal or may be injection molded as a single piece from a plastic material. In the case where metals are used, it is preferred that the components of the ladder table of the present invention be made of light-weight materials such as aluminum which may be machined, and which provide for sufficient operating strength with a minimum of weight.

The ladder table of the present invention typically will be operated by placing the hooking component 22 over ladder rung 20 followed by tightening screw locks 26 and 29 in order that the hooking component and connecting bracket are urged against, respectively, the inboard side and outboard side surfaces of sidepiece support 2 (and where used, the flange locks 27 and 30 engage the ladder flange 21*a* where present). The ladder table 33 can then be leveled by adjusting its pitch orientation and fixing that orientation by tightening wing nut 36.

In view of the foregoing disclosure, it will be within the ability of one skilled in the art to make alterations and variations to the present invention, such as through the substitution of equivalent materials and mechanical arrangements, such as the integration and disintegration of component parts, without departing from the spirit of the invention as reflected in the following claims.

What is claimed is:

1. A holding device adapted to attach to a ladder having rungs and sidepiece supports, said holding device comprising:

(a) a substantially flat holder portion defining a holder plane;

(b) an attachment portion adjustably attached to said holder portion so as to be adjustable with respect to said holder plane and lockable in at least two orientations with respect to said holder plane; and said attachment portion comprising two parallel elements opposite sides adapted to engage one of said sidepiece supports, one of said elements terminating in a hook shaped so as to engage one of said rungs, and at least one connector that connects the element so as to clamp said two elements on one of said sidepiece supports.

2. A holding device according to claim 1 wherein said holder portion and said hook are each provided with cooperating orientating surfaces, said surfaces adapted to be releasably engaged so as to allow said hook to be lockable in a plurality of orientations with respect to said holder plane.

3. A holding device according to claim 1 wherein said holder portion additionally comprises at least one drawer.

4. A holding device according to claim 1 wherein said holder portion is provided with at least one drain hole.

5. A holding device according to claim 1 wherein said holder portion comprises a material selected from the group consisting of wood, plastic and metals.

6. A holding device according to claim 1 wherein said hook portion comprises a material selected from the group consisting of wood, plastic and metals.

7. A holding device according to claim 1 wherein said two elements are connected to one another by at least two connectors having flat sides and adapted to bear against one of said sidepiece supports.

8. A holding device according to claim 7 wherein said at least two connectors are threaded bolts having flat sides.

9. A holding device according to claim 1, wherein said at least one connector additionally comprises a locking flange for engaging a longitudinal flange on one of said sidepiece supports.

10. A holding device according to claim 1 wherein said holder portion comprises a pivot member, an orientation holding member, and a locking bolt, and said attachment portion further comprises bracket member, said bracket member provided with a pivot aperture adapted to accept said pivot member so as to allow said attachment portion to pivot with respect to said holder portion, and an orientating surface adapted to releasably engage said orientation holding member so as to be capable of orienting said attachment portion in at least two orientations with respect to said holder portion; and wherein said locking bolt is adapted to be tightened so as to releasably fix said attachment portion in one of said at least two orientations with respect to said holder portion.

* * * * *

UNITED STATES PATENT AND TRADEMARK OFFICE

CERTIFICATE OF CORRECTION

PATENT NO. : 6,029,776

DATED : February 29, 2000

INVENTOR(S) : Robert L. Brown

It is certified that error appears in the above-identified patent and that said Letters Patent is hereby corrected as shown below:

IN THE ABSTRACT

In line 1 of the Abstract, after the phrase "relates to", insert - a --.

In column 2, line 37, after the phrase "top of", insert - the --.
In column 2, line 41, after "mechanism", insert -- , -- and after "screw", insert -- , --.
In column 3, line 44, delete "plan of view" and replace it with - plan view --.
In column 4, line 18, delete "made" and replace it with - mode --.
In column 4, line 33, delete "(3)" and replace it with - (4) --.
In column 5, line 1, after "same", insert - as --.
In column 6, lines 37 and 38, delete "the ladder edge 21" and replace it with - the facing side of sidepiece support 2 --.
In column 7, line 33, delete "peas" and replace it with - pegs --.

IN THE CLAIMS

In column 8, line 13, delete "opposite".
In column 8, line 14, delete "sides".
In column 8, line 14, after "engage", insert - opposite sides of --.
In column 8, line 17, delete "element" and replace it with - elements --.
In column 8, line 33, delete "portion".

UNITED STATES PATENT AND TRADEMARK OFFICE

CERTIFICATE OF CORRECTION

PATENT NO. : 6,029,776

DATED : February 29, 2000

INVENTOR(S) : Robert L. Brown

It is certified that error appears in the above-identified patent and that said Letters Patent is hereby corrected as shown below:

In column 8, line 48, after "comprises", insert - a –.

Signed and Sealed this

Eighth Day of May, 2001

*Attest:*

Nicholas P. Godici

NICHOLAS P. GODICI

*Attesting Officer*

*Acting Director of the United States Patent and Trademark Office*